US006672571B2

(12) United States Patent
Gangler et al.

(10) Patent No.: US 6,672,571 B2
(45) Date of Patent: Jan. 6, 2004

(54) FUEL REMOVAL SYSTEM FOR A CARBURETOR

(75) Inventors: Bryan K. Gangler, Unionville, MI (US); Albert L. Haas, Cass City, MI (US)

(73) Assignee: Walbro Engine Management LLC, Cass City, MI (US)

( * ) Notice: Subject to any disclaimer, the term of this patent is extended or adjusted under 35 U.S.C. 154(b) by 0 days.

(21) Appl. No.: 10/132,361

(22) Filed: Apr. 25, 2002

(65) Prior Publication Data

US 2003/0201553 A1 Oct. 30, 2003

(51) Int. Cl.[7] ..... F02M 5/08; F02M 5/12

(52) U.S. Cl. ..... 261/70; 137/43; 137/577; 137/577.5; 222/522; 222/525; 261/72.1; 261/DIG. 67

(58) Field of Search ..... 261/70, 72.1, DIG. 21, 261/DIG. 67; 137/38, 43, 577, 577.5; 222/522, 525; 141/364

(56) References Cited

U.S. PATENT DOCUMENTS 997,255 A * 7/1911 Anderson ..... 261/70 X
1,215,667 A * 2/1917 Legge ..... 137/577 X
1,625,572 A * 4/1927 Simpson ..... 261/70 X
1,733,111 A * 10/1929 Ames ..... 222/525 X
1,734,232 A * 11/1929 Ryan et al. ..... 222/519
1,859,126 A * 5/1932 Boeuf ..... 222/505
2,098,391 A * 11/1937 Irvin ..... 261/DIG. 21
3,184,091 A * 5/1965 Hoffman ..... 222/552 X
3,223,117 A * 12/1965 Curie et al. ..... 222/522 X
3,595,269 A * 7/1971 Yeagle ..... 137/577
4,986,502 A * 1/1991 Ceroke ..... 251/216
5,368,181 A * 11/1994 Myers ..... 222/553 X
5,388,606 A * 2/1995 Banks ..... 137/38
5,653,270 A * 8/1997 Burrows ..... 141/364 X
6,244,572 B1 * 6/2001 Delsole ..... 261/72.1 X

* cited by examiner

*Primary Examiner*—Richard L. Chiesa
(74) *Attorney, Agent, or Firm*—Reising, Ethington, Barnes, Kisselle, P.C.

(57) ABSTRACT

A fuel removal system for a carburetor with a float bowl carried by a body having a channel extending from the float bowl to the exterior of the carburetor body. An outlet tube is positioned within the channel and is movable from a first position wherein liquid fuel can be removed from the fuel bowl to the exterior of the body, and a second position wherein the outlet tube does not communicate with the float bowl.

21 Claims, 1 Drawing Sheet

FUEL REMOVAL SYSTEM FOR A CARBURETOR

FIELD OF THE INVENTION

This invention relates generally to a carburetor for an engine and more particularly to a carburetor with an apparatus for removing fuel from a float bowl of the carburetor.

BACKGROUND OF THE INVENTION

Float bowl carburetors are generally known in the art and include a body that is mounted on an engine or intake manifold. Float bowl carburetors generally include a fuel and air mixing passage and a fuel inlet passage to allow fuel into the carburetor. Air is supplied to the mixing passage through an air filter of an air cleaner on an air inlet side of the carburetor. The carburetor generally has a float regulated fuel supply chamber or bowl that is attached to the carburetor body. The float assembly is connected to a metering valve assembly which allows fuel to enter the bowl and maintains a substantially constant pressure of fuel within the bowl.

During the manufacturing process, engines having carburetors are usually tested before installation into a device. During such testing, fuel is supplied to the carburetor for operation of the engine. The testing is often performed at a site that is remote from the actual assembly of the engine into the completed device. Therefore, excess fuel that typically remains within the float bowl needs to be removed prior to shipment of the engine and pre-mounted carburetor to a manufacturing facility for the device.

There is, therefore, a need in the art for a system which removes unused or excess fuel from a carburetor after testing and prior to shipment. The fuel removal system should be sealable after testing to prevent subsequent leakage or seepage of fuel from the carburetor when the engine is installed and used in a device. The fuel removal system should be relatively simple and should not require significant quantities of parts or operational steps in a manufacturing process.

A fuel removal system for a carburetor, with a float bowl carried by a body of the carburetor, has a fuel outlet tube is received in a passage in the body. The fuel outlet tube is movable from a first position, communicating with a fuel pickup tube with an inlet adjacent the bottom of the float bowl, to a second position closing off communication with and sealing the pick up tube from the outlet tube. Preferably and at least when moved to the second position, the outlet tube is press fit in the body to provide a permanent closure and seal. The fuel removal system also has few parts, is a simple design which is economical to manufacture and assemble, requires no maintenance in service and has a long useful life.

The fuel removal system of the present invention has the advantage of providing an integrated system that does not require the use of extraneous parts such as a separate plug or other device to seal a channel between an exterior of the carburetor and the fuel bowl.

The fuel removal system of the present invention has the further advantage of providing a fuel removal system that simplifies the required steps to be performed after an engine test is completed, as well as ensures a permanent seal of the fueel removal system after the engine has been tested.

Additionally, the fuel removal system of the present invention has the advantage of providing a sealing outlet tube that may be utilized as an extension for a vacuum connection and further used to seal the system after the fuel has been removed from the float bowl.

BRIEF DESCRIPTION OF THE DRAWINGS

These and other objects, features and advantages of the present invention will become more readily appreciated when considered in connection with the following detailed description of the preferred embodiment and appended claims and accompanying drawings where:

DETAILED DESCRIPTION OF THE PREFERRED EMBODIMENTS

Figure 1:
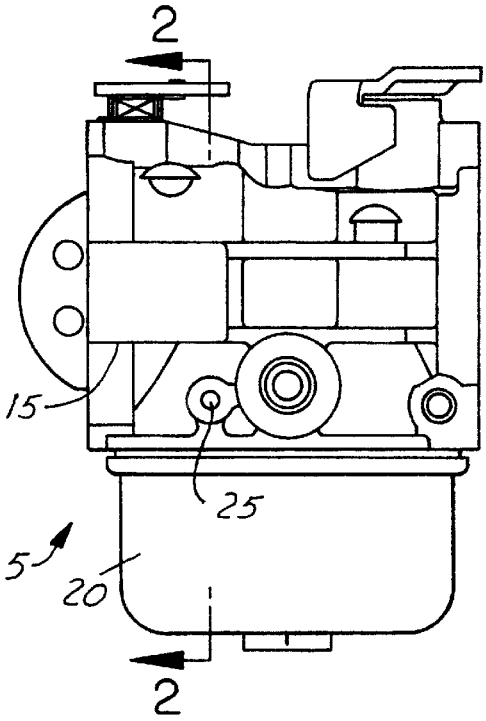
FIG. 1 is a side view of a float bowl carburetor including the fuel removal system of the present invention.
Figure 2:
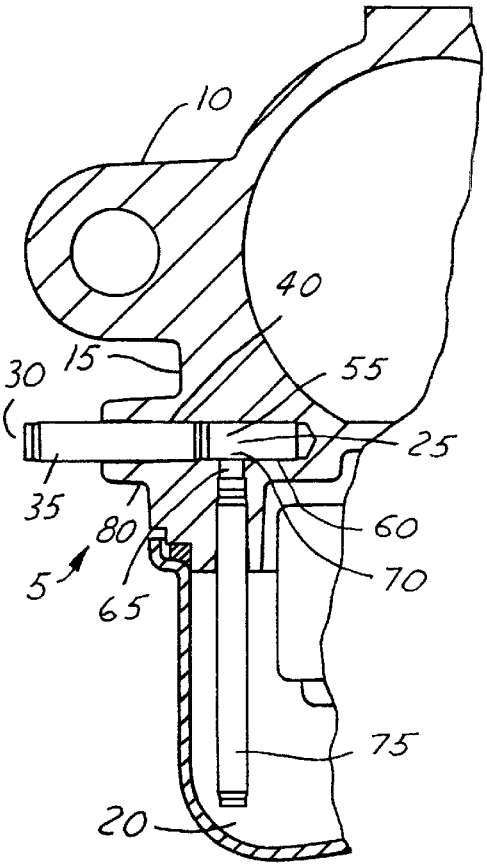
FIG. 2 is a fragmentary sectional view showing the fuel removal system of the present invention wherein the outlet tube is in a first position.
Figure 3:
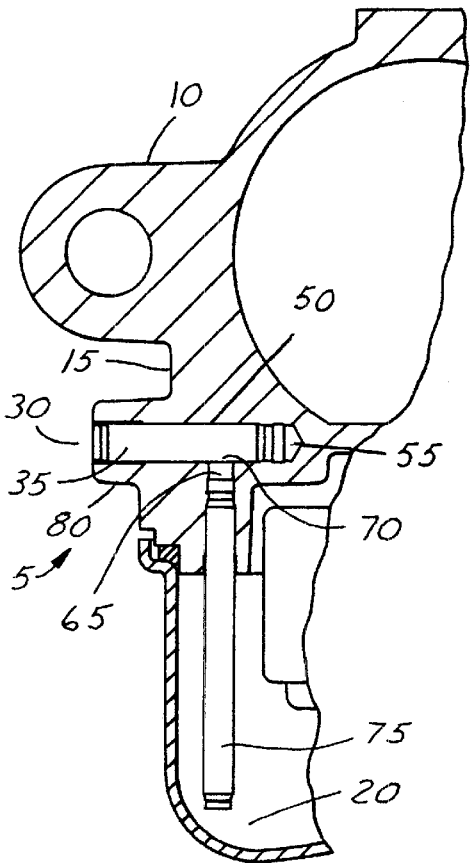
FIG. 3 is a fragmentary sectional view showing the fuel removal system of the present invention wherein the outlet tube is in a second position such that fuel may not be removed from the carburetor.

Referring in more detail to the drawings, FIG. 1 illustrates a carburetor embodying a fuel removal system 5 of the present invention. The fuel removal system 5 includes a float bowl carburetor 10 with a body 15 that has a fuel bowl 20 formed therein. As shown in FIGS. 2–3, a channel or angled bore 25 is formed through the body 15 and extends from the fuel bowl 20 to an exterior 30 of the body 15.

A selectively positioned or movable outlet tube 35 is sold ably received slidably in a linearly extending second bore 55 which forms a first section of the channel 25. The outlet tube 35 moves between a first position 40, as shown in FIG. 2, and a second position 50, as shown in FIG. 3. When in the first position 40, liquid fuel can be removed from the fuel bowl 20 to the exterior 30 through the center of the hollow tube 35. When in the second Position 50, the outlet tube 35 through a radial or lateral Dress pressed interference fit of the tube 35 to the body 15 blocks or closes a linearly extending intersection bore 65, which forms a second section of the channel 25, and thereby prevents communication between the fuel bowl 20 and the exterior 30.

Preferably, the bore 55 of the bi-sectional channel 25 extends from the exterior 30 to an area 60 above the fuel bowl 20 and the second section or bore 65 extends from the fuel bowl 20 and intersects the first section or bore 55 of the channel 25 at an intersection port 70 which is opened and closed by the outlet tube 35. To facilitate manufacture, preferably the first section 55 and second section 65 of the angled channel 25 intersect at an angle of approximately 90°. However, variations of the angle of intersection may be utilized without departing from the concept of the present invention.

Preferably, the first section 55 of the channel 25 extends beyond the intersection port 70 of the first section 55 and second section 65 of the channel 25 in a direction away from the exterior 30 sufficiently to permit the movable outlet tube 35 to be positioned flush or countersunk in relation with the exterior 30 or wholly within the channel 25 to prevent removal, after the outlet tube 35 is moved to the second position 50. This provides a tamper proof construction.

The fuel removal system 5 has a suction tube 75 received slidably in the second section 65 of the channel 25 during assembly and , such that the suction tube 75 projects into the fuel bowl 20 with its distal or free end disposed immediately adjacent the bottom of the fuel bowl. The suction tube 75 enables fuel to be removed from the fuel bowl 20 when a suction device is applied to outlet tube 35 when in the first position 40. Preferably. the suction tube secures and seals radially outward to the cylindrical surface of the body 15 which defines the second section 65 of the channel 25 during assembly via a press fit so that a separate seal is not required.

The outlet tube 35 preferably is sized such that there is a pressed interference fit in relation to the first section 55 of the channel 25. The outlet tube 35 is preferably a brass tube, although other materials including fuel resistant plastics may be utilized. The outlet tube 35 when in a first position 40, as shown in FIG. 2, extends beyond the exterior surface of a boss 80 that is formed on the body 15 of the carburetor, corresponding to a position of the channel 25 extending to the exterior 30. The portion of the outlet tube 35 projecting beyond the exterior surface of the boss 80 allows for a vacuum hose to be attached for removing unused or excess fuel from the fuel bowl 20. When the outlet tube 35 is in the first position 40, the intersection port 70 of the first section 55 and second section 65 is open allowing for communication between the fuel bowl 20 and the exterior 30.

As shown in FIG. 3, when the outlet tube 35 is in the second position 50. the intersection port 70, located between the first section 55 and second section 65 is permanently closed and sealed preventing communication through the channel 25 between the fuel bowl 20 and the exterior 30.

In use, as shown in FIG. 2, the fuel removal system 5 is provided on a float bowl carburetor 10 such that the movable outlet tube 35 is initially in the first position 40. When an engine is tested prior to shipment to a device manufacturing facility, excess fuel can be removed from the fuel bowl 20 to the exterior 30 of the carburetor. attaching the vacuum hose to the outlet tube 35 when in the first position 40. Once attached, the fuel in the bowl 20 flows through the suction tube 75 into the second section 65 of the channel 25 and then through the first section 55 of the channel 25, and through the outlet tube 35. Once the fuel has been removed from the fuel bowl 20, the vacuum device is removed and the movable outlet tube 35 is pushed along the first section 55 of the channel 25 until the outlet tube 35 press fits and seals into the second position 50, as shown in FIG. 3.

In this manner, the fuel removal system 5 provides an integrated system that does not require the use of extra parts not included as a portion of the carburetor 10. The design allows an operator to simply press the outlet tube 35 along the channel 25 after fuel has been removed from the bowl without the need for installing a device, such as a non-integral threaded plug, which is difficult and time consuming to insert into the channel 25. Because of the pressed interference fit of the outlet tube with the channel 25, the outlet tube 35 is irreversibly situated after it has been moved to its second position 50 and that provides a permanent tamper proof closure and seal.

While a preferred embodiment is disclosed, a skilled worker in this art would understand that various modifications would come within the spirit and scope of the invention as described by the following claims.

What is claimed is:

1. A fuel removal system for a carburetor comprising:

a float bowl carburetor body, having a fuel bowl carried by the body;

a channel formed through the body and extending from the fuel bowl to an exterior of the body;

an outlet tube received in the channel and communicating axially with the channel; and wherein the outlet tube is axially movable in the channel from a first position wherein liquid fuel may be removed from the fuel bowl to the exterior through the outlet tube to a second position wherein the outlet tube blocks a portion of the channel to prevent communication through the channel between the fuel bowl and the exterior.

2. The fuel removal system of claim 1 wherein the channel comprises a multi-sectioned conduit.

3. The fuel removal system of claim 2 wherein the channel comprises a bi-sectional conduit.

4. The fuel removal system of claim 1 wherein the movable outlet tube comprises a tube sized such that it is received with an interference fit in the channel at least when in the second position.

5. The fuel removal system of claim 1 wherein the body further includes a boss formed thereon through which the channel extends to the exterior of the body.

6. The fuel removal system set forth in claim 1 wherein the outlet tube is countersunk into the body in relation to the exterior of the body when in the second position to prevent removal and tampering of the outlet tube.

7. A fuel removal system for a carburetor comprising: a float bowl carburetor body, having a fuel bowl carried by the body;

a channel formed through the body and extending from the fuel bowl to an exterior of the body;

an outlet tube received in the channel and being movable in the channel from a first position wherein liquid fuel may be removed from the fuel bowl to the exterior through the outlet tube to a second position wherein the outlet tube blocks a portion of the channel to prevent communication through the channel between the fuel bowl and the exterior; and wherein a first section of the channel extends from the exterior to an area above the fuel bowl.

8. The fuel removal system of claim 7 wherein a second section of the channel extends from the fuel bowl and intersects the first section of the channel.

9. The fuel removal system of claim 8 wherein the first and second sections of the channel intersect at an angle of approximately 90 degrees.

10. The fuel removal system of claim 8 wherein the first section extends beyond an intersection port of the first and second sections of the channel in a direction away from the exterior.

11. The fuel removal system of claim 7 wherein the movable outlet tube is positioned within the first section of the channel.

12. The fuel removal system of claim 11 wherein the intersection port of the first and second sections is open when the movable outlet tube is in the first position.

13. The fuel removal system of claim 11 wherein the intersection port of the first and second sections is closed when the movable outlet tube is in the second position.

14. The fuel removal system of claim 13 wherein the first section extends sufficiently beyond the intersection port of the first and second sections of the channel so that the outlet tube is received completely within the first section when in the second position.

15. The fuel removal system of claim 8 further including a suction tube received in the second section of the channel and extending into the fuel bowl.

16. The fuel removal system of claim 15 wherein the suction tube comprises a tube sized such that it is received with an interference fit in the second section of the channel.

17. A fuel system for a carburetor comprising:

a float bowl carburetor body having a fuel bowl carried by the body;

a bi-sectioned channel having a first section extending from an exterior of the body to an area above the fuel bowl and a second section extending from the fuel bowl and intersecting the first section of the channel;

an outlet tube received in the first section of the channel; and movable in the channel from a first position wherein a liquid fuel may be removed from the fuel bowl through the outlet tube to the exterior to a second position wherein the outlet tube blocks the second section of the channel to prevent communication between the fuel bowl and the exterior.

18. A fuel system for a carburetor comprising:

a float bowl carburetor body having a fuel bowl carried by the body;

a first passage extending into the body from an exterior of the body;

a second passage communicating with the fuel bowl and intersecting the first passage;

an outlet tube received in the first passage; and movable therein from a first position wherein the intersection of the first and second passages is open to allow a liquid fuel to be removed from the fuel bowl through the outlet tube to the exterior to a second position wherein the intersection of the first and second passages is closed and sealed by the outlet tube to prevent communication between the fuel bowl and the exterior.

19. The fuel system for a carburetor of claim 18 wherein the first passage comprises a bore with a sidewall, the second passage intersects the sidewall in a port therein, and when in the second position the outlet tube overlies the port, and seals the port so that the first passage does not communicate with the second passage.

20. The fuel system of claim 19 wherein the outlet tube when in the second position is received with an interference fit in the bore.

21. A fuel removal system for a carburetor comprising:

a body having an exterior;

a fuel bowl carried by the body;

a first bore carried by the body and communicating through the exterior;

a second bore carried by the body and communicating laterally with the first bore and extending between the first bore and the fuel bowl;

a port carried by the body and formed by the intersecting first and second bores; and an outlet tube having opposite open ends, a continuous cylindrical wall fitted slidably into the first bore, a first position for draining fuel from the fuel bowl through the port and a second position for sealing-off the port by the continuous cylindrical wall.

* * * * *